US006649126B2

(12) United States Patent
Komazaki et al.

(10) Patent No.: US 6,649,126 B2
(45) Date of Patent: Nov. 18, 2003

(54) ALUMINUM ALLOY FOR HIGH PRESSURE DIE-CASTING

(75) Inventors: Toru Komazaki, Tokyo (JP); Naomi Nishi, Tokyo (JP); Izumi Murashima, Fuchu (JP); Hideto Sasaki, Fuchu (JP)

(73) Assignee: Ryobi Ltd., Hiroshima-ken (JP)

( * ) Notice: Subject to any disclaimer, the term of this patent is extended or adjusted under 35 U.S.C. 154(b) by 0 days.

(21) Appl. No.: 10/059,154

(22) Filed: Jan. 31, 2002

(65) Prior Publication Data

US 2002/0141896 A1 Oct. 3, 2002

(30) Foreign Application Priority Data

Feb. 1, 2001 (JP) ..... 2001-025682

(51) Int. Cl.[7] ..... C22C 21/06
(52) U.S. Cl. ..... 420/543; 420/547
(58) Field of Search ..... 420/543, 547

(56) References Cited

U.S. PATENT DOCUMENTS 1,932,843 A 10/1933 Dean et al.
3,868,250 A * 2/1975 Zimmermann ..... 420/535

FOREIGN PATENT DOCUMENTS

| | | |
|---|---|---|
| EP | 0 992 600 | 4/2000 |
| JP | 1-247549 | 10/1989 |
| JP | 2-159339 | 6/1990 |

OTHER PUBLICATIONS

Abstract No. 04218640, dated Aug. 10, 1992.

* cited by examiner

*Primary Examiner*—George Wyszomierski
*Assistant Examiner*—Janelle Combs-Morillo
(74) *Attorney, Agent, or Firm*—Sughrue Mion, PLLC

(57) ABSTRACT

An aluminum alloy for high pressure die-casting capable of providing a sufficient castability and a tensile strength of not less than 320 MPa and elongation of not less than 20%, The aluminum alloy contains from 3.6 to 5.5 mass % of Mg, from 0.6 to 1.2 mass % of Mn, from 0.2 to less than 0.5 mass % of Ni, from 0.001 to 0.010 mass % of Be, from 0.01 to 0.3 mass % of Ti, from 0.001 to 0.05 mass % of B, and the balance aluminum and inevitable impurities. The aluminum alloy is particularly available as a material of a vehicle frame and a vehicle body.

2 Claims, 2 Drawing Sheets

ALUMINUM ALLOY FOR HIGH PRESSURE DIE-CASTING

BACKGROUND OF THE INVENTION

The present invention relates to an aluminum alloy for high pressure die-casting, and more particularly, to the alloy for providing parts and components of a vehicle.

Conventionally, ADC10 alloy or ADC12 alloy are used as a high pressure die-casting material, in case that parts and components of a vehicle are produced by high pressure die-casting in light of mass-production and productivity. These alloys are Al—Si—Cu alloy and are available for a product having a complicated configuration such as a cover member and a case, because these materials have relatively high strength and provide sufficient castability.

In view of a recent trend of environmental protection and recycling, a demand of producing a frame and a body of a vehicle with aluminum alloy by high pressure die-casting is bringing into attention because the aluminum alloy is light in weight and is capable of recycling. However, ADC10 alloy and ADC12 alloy provide inferior ductility and toughness, and therefore are not available as a material of the frame and body of the vehicle.

Laid open Japanese Patent Application Publication Nos. Hei 1-247549 and Hei 11-193434 disclose a composite alloy in which Mn and Ni are added into Al—Mg multiple elements alloy. This alloy is available for high pressure die-casting. However, such composite alloy is not appropriate as a material of the frame and body of the vehicle, because elongation is low such as about 10%. Further, a material exhibiting high elongation available for the frame and body generally provides low mechanical strength at high temperature. Therefore, a cast product made from the highly elongatable material may be deformed when separating from a metal mold of a high pressure die-casting apparatus.

In case of a low pressure die-casting other than the high pressure die-casting, AC 4CH alloy providing relatively high elongation is used and a cast product is subjected to T6 treatment (defined by JIS H 0001), or AC7A alloy is used. These materials provide a sufficient strength and elongation required in the frame and the body. However, such materials are not available for producing thin and elongated parts such as a pillar of the vehicle body. Further, the cast product must be subjected to heat treatment in the employment of AC 4CH alloy, which is costly. Moreover, thermal seizure to the metal mold may often occur in the employment of AC7A alloy, which is detrimental to the cast product.

SUMMARY OF THE INVENTION

It is an object of the present invention to overcome the above-described problems and to provide an aluminum alloy for a high pressure die-casting available for producing a frame and body of a vehicle while meeting with the requirements of mechanical strength (not less than 250 MPa) and elongation (not less than 15%), yet reducing defects of casting.

This and other objects of the present invention will be attained by providing an aluminum alloy for high pressure die-casting containing from 3.6 to 5.5 mass % of Mg, from 0.6 to 1.2 mass % of Mn, from 0.2 to less than 0.5 mass % of Ni, and the balance aluminum and inevitable impurities.

With the composition, resultant cast product can pro-vide strength of not less than 320MPa and elongation of not less than 20%, those meeting with the requirements in the frame and body of a vehicle. Further, insufficient casting can be reduced.

Preferably, the aluminum alloy further contains from 0.001 to 0.010 mass % of Be. This arrangement can prevent Mg from being oxidized. Therefore, reduction in density of Mg can be avoided.

Further preferably, the aluminum alloy further includes at least one of from 0.01 to 0.3 mass % of Ti and from 0.001 to 0.05 mass % of B. With this arrangement, crystal grain refinement can be promoted to enhance castability.

DETAILED DESCRIPTION OF THE PREFERRED EMBODIMENTS

Figure 1:
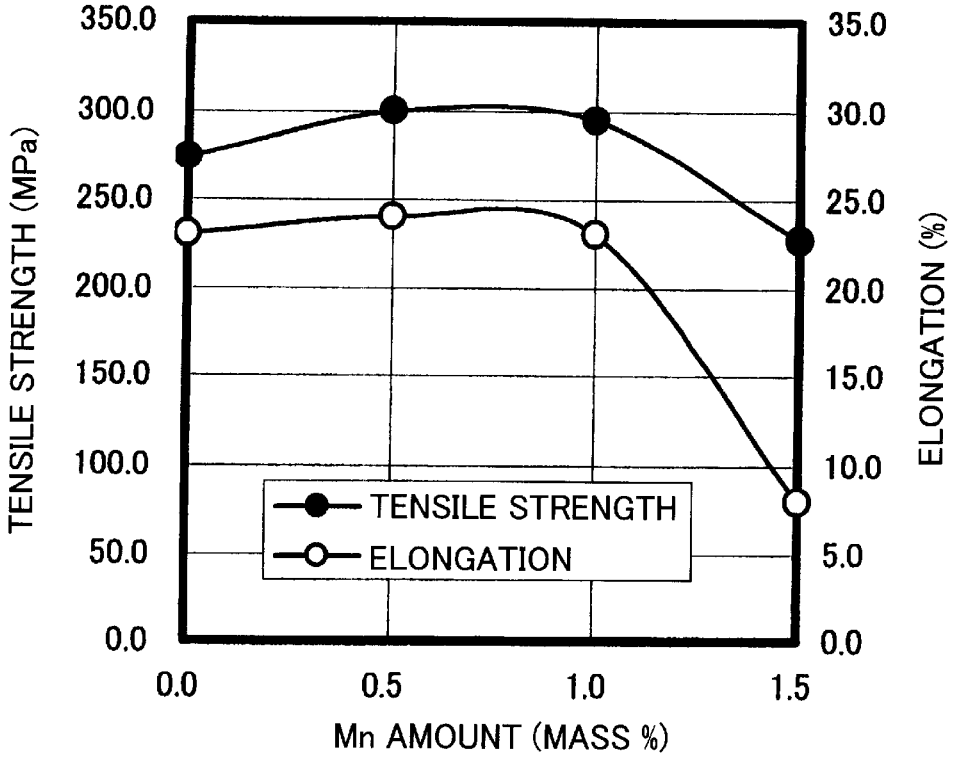
FIG. 1 is the graphical representation showing the relationship between Mn amount and tensile strength and between the Mn amount and elongation with respect to an alloy whose composition is approximately the same as that of AC7A alloy except for amount of Mn.

An aluminum alloy for high pressure die-casting according to one embodiment of the present invention will be described. An aluminum alloy for high pressure die-casting according to the embodiment contains from 3.6 to 5.5 mass % of Mg(magnesium), from 0.6 to 1.2 mass % of Mn(manganese), from 0.2 to less than 0.5 mass % of Ni(nickel), and the balance aluminum and inevitable impurities. If desired, from 0.001 to 0.010 mass % of Be(beryllium) is added. Further, if desired, at least one of from 0.01 to 0.3 mass % of Ti(titanium) and from 0.001 to 0.05 mass % of B(boron) is (are) added. In the latter case, the resultant composition includes or does not include Be.

Mg is solid-solved in a matrix upon alloying. By the solid-solution, strength, proof stress (0.2% offset) and hardness of the resultant alloy can be improved. If Mg amount is less than 3.5 mass %, sufficient alloy strength cannot be provided, and casting temperature becomes increased due to increase in liquidus temperature. On the other hand, if Mg amount exceeds 5.5 mass %, elongation is lowered and stress corrosion cracking may easily occur even though the alloy strength can be improved. Thus, Mg amount is defined into from 3.6 to 5.5 mass %.

Addition of Mn into alloy composition can restrain thermal seizure of the alloy to a metal mold. If Mn amount is less than 0.6 mass %, thermal seizure of the alloy to the metal mold occurs to cause failure of casting. On the other hand, if Mn amount exceeds 1.2 mass %, elongation becomes remarkably low, which is not available as the material of a vehicle frame and a vehicle body. Thus, Mn amount is defined into from 0.6 to 1.2 mass %.

FIG. 1 shows tensile strength and elongation those depending on Mn amount in an alloy whose composition is similar to that of AC7A alloy except the amount of Mn. As is apparent from the graph, if Mn amount exceeds 1.2 mass %, tensile strength becomes lowered, and elongation becomes less than 20%.

Addition of Ni into alloy composition can enhance strength of the alloy at high temperature atmosphere. This is advantageous in preventing the cast product from being deformed when separating from the metal mold. Further, Ni improves strength of the alloy in a normal temperature. If Ni amount is less than 0.2 mass %, sufficient strength cannot be obtained. On the other hand, if Ni amount exceeds 0.5 mass %, elongation is remarkably lowered, which is not available as a material for the vehicle frame and vehicle body. Thus, amount of Ni is defined into from 0.2 to 0.5 mass %.

Figure 2:
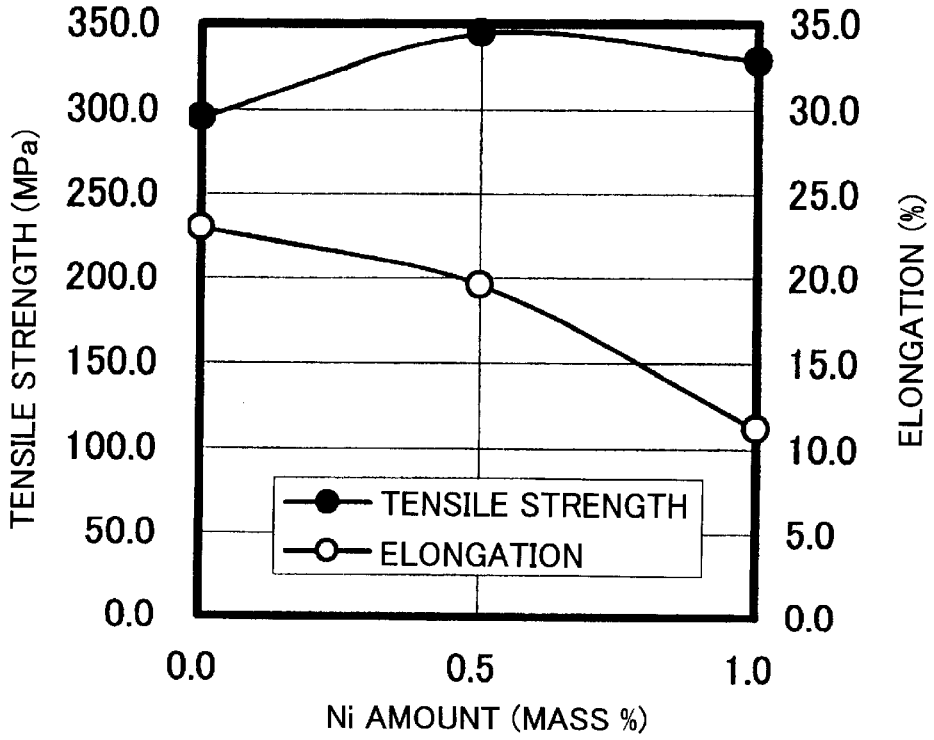
FIG. 2 is the graphical representation showing the relationship between Ni amount and tensile strength and between the Ni amount and elongation with respect to an alloy whose composition is approximately the same as that of AC7A alloy except for a fixed amount of Mn of 1.0 mass % and amount of Ni.

FIG. 2 shows tensile strength and elongation those depending on Ni amount in an alloy whose composition is similar to that of AC7A alloy except the amount of Ni and a fixed amount of Mn of 1.0 mass %. As is apparent from FIG. 2, elongation becomes less than 20% if Ni amount exceeds 0.5 mass %.

Be serves to prevent Mg density from being lowered in the alloy due to oxidation thereof. If Be amount is less than 0.001 mass %, oxidation of Mg cannot be sufficiently restrained. On the other hand, if Be amount exceeds 0.010 mass %, crystallization of compound occurs to reduce strength of a resultant alloy. In this connection, Be amount is defined into from 0.001 to 0.010 mass %. However, Be can be dispensed with.

Ti and B serve to provide fine crystal grain to improve castability. Fine crystal grain can be provided by the addition of Ti only or by the addition of B only. However, because of composite effect by the addition of both Ti and B, extremely fine crystal grain can be provided. If Ti amount is less than 0.01 mass % and if B amount is less than 0.001 mass %, fine crystal grain cannot be obtained. On the other hand, if Ti amount exceeds 0.3 mass % or B amount exceeds 0.1 mass %, detrimental compound is formed to lower elongation of the resultant alloy. Thus, Ti amount is defined into from 0.01 to 0.3 mass % and B amount is defined into from 0.001 to 0.1 mass %. However, extremely remarkable improvement on mechanical property of the alloy is not found by the addition of Ti and B. and therefore, these can be dispensed with.

Addition of Si may lead to degradation in anodic oxidation. Therefore, Si is inappropriate as a component of the alloy used for a body in which a particular attention is drawn to its outer appearance, such as a body of a motorcycle. In this connection, Si is considered to be an impurity inevitably contained in the alloy. Further, addition of Cu and Fe causes degradation of corrosion resistance of the alloy. Thus, Cu and Fe are also considered to be impurities inevitably contained in the alloy.

Test pieces in accordance with the above described embodiment and comparative test pieces were produced for tensile strength test. Compositions of test pieces 1 through 9 are shown in Table 1 in which a unit of data is mass %. Si amount of 0.1 mass % and Fe amount of 0.2 mass % can be regarded as impurities.

Test pieces 1 and 2 are in accordance with the above-described embodiment. Test piece 9 was formed of ADC10 alloy. 5 Test pieces 1 through 9 were produced using 90 tons high pressure die-casting machine at a casting temperature of 720±10° C., metal mold temperature of 150±20° C., injection speed of from 1.8 m/s to 2.0 m/s, casting pressure of 75 MPa, and curing time of 5 seconds. A metal mold was designed for JL casting two ASTM test rods at one time for use in tensile strength test and an impact test.

TABLE 1

| | Mg | Mn | Ni | Si | Fe | Ti | Be | Al |
|---|---|---|---|---|---|---|---|---|
| Test piece 1 | 4.9 | 0.8 | 0.3 | 0.1 | 0.2 | — | 0.007 | Re |
| Test piece 2 | 4.9 | 0.8 | 0.3 | 0.1 | 0.2 | 0.1 | 0.007 | Re |
| Test piece 3 | 5.0 | 0.2 | — | 0.1 | 0.2 | — | — | Re |
| Test piece 4 | 5.0 | 0.6 | — | 0.1 | 0.2 | — | — | Re |
| Test piece 5 | 4.9 | 1.0 | — | 0.1 | 0.2 | — | — | Re |
| Test piece 6 | 4.8 | 1.8 | — | 0.1 | 0.2 | — | 0.007 | Re |
| Test piece 7 | 4.9 | 1.0 | 0.6 | 0.1 | 0.2 | — | 0.007 | Re |
| Test piece 8 | 5.0 | 1.0 | 1.0 | 0.1 | 0.2 | — | 0.007 | Re |
| Test piece 9 | <0.3 | <0.5 | <0.5 | 7.5–9.5 | <1.3 | — | — | Re |

Table 2 below shows castability, tensile strength and elongation of these test pieces in their as cast condition. Units of the tensile strength and elongation are MPa and %, respectively. Further, in Table 2, a circle indicates a sufficient casting quality, "X" indicates an insufficient casting quality, and a triangle indicates an intermediate casting quality.

As is apparent from Table 2, test pieces 1 and 2 in accordance with the present embodiment provided the tensile strength of not less than 320 MPa, and elongation of not less than 20% those being required for the material of the vehicle frame and vehicle body. On the other hand, test pieces 3 through 6 those lacking Ni provided the tensile strength of less than 320 MPa. Particularly, the test piece 3 whose Mn amount is less than that of the test pieces 1 and 2 provided insufficient castability.

Further, the test piece 6 whose Mn amount is greater than that of the test pieces 1 and 2 provided extremely low elongation. Moreover, the test pieces 7 and 8 whose Ni amount is greater than that of the test pieces 1 and 2 provided the elongation of less than 20%. The test piece 9 which is ADC10 alloy conventionally used as a material for a case and a cover of the vehicle provided insufficient tensile strength and elongation unavailable for the material of the vehicle frame and body.

TABLE 2

| | Castability | Tensile strength | Elongation |
|---|---|---|---|
| Test piece 1 | Δ | 327 | 20.0 |
| Test piece 2 | ○ | 339 | 22.7 |
| Test piece 3 | X | 274 | 23.0 |
| Test piece 4 | Δ | 300 | 24.0 |
| Test piece 5 | Δ | 295 | 23.0 |
| Test piece 6 | Δ | 227 | 8.0 |

TABLE 2-continued

| | Castability | Tensile strength | Elongation |
|---|---|---|---|
| Test piece 7 | Δ | 345 | 19.6 |
| Test piece 8 | Δ | 328 | 11.2 |
| Test piece 9 | ○ | 299–319 | 1.5–4.0 |

Figure 3:
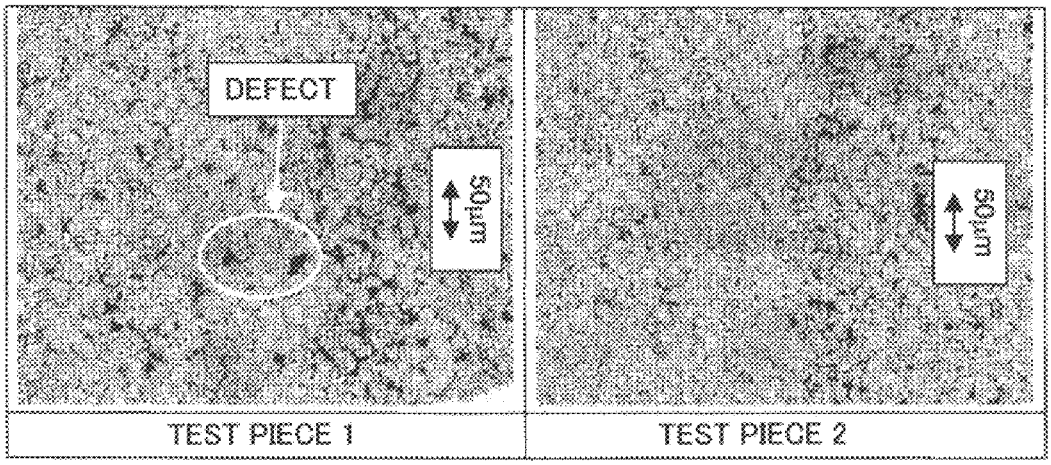
FIG. 3 is a microscopic photograph showing internal structures of test pieces 1 and 2.

Internal structures of the test pieces 1 and 2 are shown in microscopic photographs of FIG. 3 These are cross-sectional cut surfaces of these samples. The test piece 1 not containing Ti has defective portions indicated by black color. On the other hand, in the test piece 2 in which 0.1 mass % of Ti was added to the compositions of the test piece 1 no critical defective portion can be found. Thus, addition of Ti can lead to fine crystallization of the alloy to reduce the internal defect of the cast product.

While the invention has been described in detail with reference to specific embodiments thereof, it would be apparent to those skilled in the art that various changes and modifications may be made therein without departing from the spirit and scope of the invention.

What is claimed is:

1. An aluminum alloy for high pressure die-casting consisting essentially of from 3.6 to 5.5 mass % of Mg, from 0.6 to 1.2 mass % of Mn, from 0.2 to less than 0.5 mass % of Ni, from 0.01 to 0.3 mass % of Ti, from 0.001 to 0.05 mass % of B, and the balance aluminum and inevitable impurities.

2. The aluminum alloy as claimed in claim 1, further containing from 0.001 to 0.010 mass % of Be.

* * * * *